US010490367B2

(12) United States Patent
Hayashi et al.

(10) Patent No.: US 10,490,367 B2
(45) Date of Patent: Nov. 26, 2019

(54) METHOD FOR MANUFACTURING ELECTRODE MATERIAL AND ELECTRODE MATERIAL

(71) Applicant: MEIDENSHA CORPORATION, Tokyo (JP)

(72) Inventors: Shota Hayashi, Tokyo (JP); Keita Ishikawa, Tokyo (JP); Kenta Yamamura, Numazu (JP); Kosuke Hasegawa, Numazu (JP)

(73) Assignee: MEIDENSHA CORPORATION, Tokyo (JP)

( * ) Notice: Subject to any disclaimer, the term of this patent is extended or adjusted under 35 U.S.C. 154(b) by 0 days.

(21) Appl. No.: 15/738,275

(22) PCT Filed: Jun. 21, 2016

(86) PCT No.: PCT/JP2016/068324
§ 371 (c)(1),
(2) Date: Dec. 20, 2017

(87) PCT Pub. No.: WO2016/208551
PCT Pub. Date: Dec. 29, 2016

(65) Prior Publication Data

US 2018/0182573 A1 Jun. 28, 2018

(30) Foreign Application Priority Data

Jun. 24, 2015 (JP) ..... 2015-126086

(51) Int. Cl.
*H01H 11/04* (2006.01)
*B22F 1/00* (2006.01)
(Continued)

(52) U.S. Cl.
CPC ..... *H01H 11/048* (2013.01); *B22F 1/00* (2013.01); *B22F 1/0011* (2013.01); *B22F 3/10* (2013.01);
(Continued)

(58) Field of Classification Search
CPC .. H01H 11/048; H01H 1/0206; H01H 33/664; H01H 11/04; B22F 1/0011;
(Continued)

(56) References Cited

U.S. PATENT DOCUMENTS 5,330,702 A * 7/1994 Kippenberg ..... B22F 3/15 419/28
6,107,582 A 8/2000 Okutomi et al.
(Continued)

FOREIGN PATENT DOCUMENTS

CN 1213153 A 4/1999
JP 4-334832 A 11/1992
(Continued)

OTHER PUBLICATIONS

Yoshioka et al, JP 04-334832, published 1992, machine translation. (Year: 1992).*
(Continued)

*Primary Examiner* — Keith Walker
*Assistant Examiner* — John A Hevey
(74) *Attorney, Agent, or Firm* — Foley & Lardner LLP

(57) ABSTRACT

It is a method for manufacturing an electrode material containing Cu, Cr, a heat-resistant element, and a low melting metal. A Cr powder and a heat-resistant element powder are mixed together in a ratio such that the Cr is greater than the heat-resistant element by weight. The mixed powder of the heat-resistant element and the Cr powder is baked. A MoCr solid solution obtained by the baking and containing a solid solution of the heat-resistant element and
(Continued)

the Cr is pulverized and then classified. The classified MoCr solid solution powder, a Cu powder, and a low-melting metal powder are mixed together, followed by sintering at a temperature that is 1010° C. or higher and is lower than 1038° C., thereby obtaining the electrode material.

10 Claims, 3 Drawing Sheets

(51) Int. Cl.

| | |
|---|---|
| ***B22F 3/00*** | (2006.01) |
| ***C22C 1/04*** | (2006.01) |
| ***C22C 9/00*** | (2006.01) |
| ***C22C 9/10*** | (2006.01) |
| ***C22C 30/02*** | (2006.01) |
| ***H01H 33/664*** | (2006.01) |
| ***H01H 1/02*** | (2006.01) |
| ***B22F 7/00*** | (2006.01) |
| ***B22F 3/10*** | (2006.01) |

(52) U.S. Cl.
CPC ..... *B22F 7/00* (2013.01); *C22C 1/04* (2013.01); *C22C 9/00* (2013.01); *C22C 9/10* (2013.01); *C22C 30/02* (2013.01); *H01H 1/0206* (2013.01); *H01H 33/664* (2013.01); *B22F 2301/10* (2013.01); *B22F 2301/20* (2013.01); *H01H 11/04* (2013.01)

(58) Field of Classification Search
CPC ..... B22F 7/00; B22F 1/00; B22F 3/10; B22F 2301/20; B22F 2301/10; C22C 30/02; C22C 9/10; C22C 9/00; C22C 1/04
See application file for complete search history.

(56) References Cited

U.S. PATENT DOCUMENTS

| | | | |
|---|---|---|---|
| 6,551,374 | B2 | 4/2003 | Doh et al. |
| 2005/0092714 | A1 | 5/2005 | Kikuchi et al. |

FOREIGN PATENT DOCUMENTS

| | | | |
|---|---|---|---|
| JP | 2002-180150 | A | 6/2002 |
| JP | 2005-135778 | A | 5/2005 |

OTHER PUBLICATIONS

Werner F. Rieder et al., The Influence of Composition and Cr Particle Size of Cu/Cr Contacts on Chopping Current, Contact Resistance, and Breakdown Voltage in Vacuum Interrupters, IEEE Transactions on Components, Hybrids, and Manufacturing Technology, vol. 12, No. 2, Jun. 1989, pp. 273-283.
Chinese Office Action and English translation, Application No. 201680036680.X, dated Jul. 11, 2018, 12 pages.

* cited by examiner

METHOD FOR MANUFACTURING ELECTRODE MATERIAL AND ELECTRODE MATERIAL

TECHNICAL FIELD

The present invention relates to a method for manufacturing an electrode material, which is used for an electrode of vacuum interrupters, etc., and to the electrode material.

BACKGROUND ART

The contact material of vacuum interrupters is required to satisfy characteristics, such as (1) the breaking capacity being large, (2) the withstand voltage capability being high, (3) the contact resistance being low, (4) the deposition resistance property being high, (5) the contact consumption being low, (6) the chopped current being low, (7) the workability being excellent, and (8) the mechanical strength being high.

Since some of these characteristics conflict with each other, there is no contact material satisfying all of the above characteristics. Cu—Cr electrode materials have characteristics, such as the breaking capacity being large, the withstand voltage capability being high, and the deposition resistance property being high. Therefore, they are widely used as contact materials of vacuum interrupters. Furthermore, there is a report that, in Cu—Cr electrode materials, one having a finer particle size of Cr particles is superior in breaking current and contact resistance (for example, Non-patent Publication 1).

In recent years, there has been progress in making vacuum interrupters conducting are extinction of vacuum circuit breakers have smaller sizes and larger capacities. Thus, there has been an increasing demand for Cu—Cr based contact materials having withstand voltage capabilities superior to those of conventional ones, which are essential for making vacuum interrupters have smaller sizes.

For example, in Patent Publication 1, there is described a method for manufacturing an electrode material, in which, as a Cu—Cr based electrode material excellent in electrical characteristics such as current breaking capability and withstand voltage capability, respective powders of Cu used as a base material, Cr for improving electrical characteristics, and a heat-resistant element (Mo, W, Nb, Ta, V, Zr) for making the Cr particles finer are mixed together, and then the mixed powder is put into a mold, followed by pressure forming and making a sintered body. Specifically, a heat-resistant element, such as Mo, W, Nb, Ta, V or Zr, is added to a Cu—Cr based electrode material containing as a raw material a Cr having a particle size of 200-300 μm, and the Cr is made fine through a fine texture technology, an alloying process of the Cr element and the heat-resistant element is accelerated, the precipitation of fine Cr—X (Cr making a solid solution with the heat-resistant element) particles in the inside of the Cu base material texture is increased, and the Cr particles having a diameter of 20-60 μm in a configuration to have the heat-resistant element in its inside are uniformly dispersed in the Cu base material texture.

Furthermore, in Patent Publication 2, without going through the fine texture technology, a powder obtained by pulverizing a single solid solution that is a reaction product of a heat-resistant element is mixed with a Cu powder, followed by pressure forming and then sintering to manufacture an electrode material containing Cr and the heat-resistant element in the electrode texture.

By forming an arc-resistant metal's fine dispersion texture as described in Patent Publication 2, withstand voltage capability and breaking capability are improved, but deposition resistance capability becomes worse to result in a deposition between the electrodes when applying a large current in a closed condition of the electrodes. This lowering of deposition resistance capability causes vacuum circuit breakers to have larger sizes, and this has been a task for mass-production.

Thus, we tried to manufacture an electrode material having superior withstand voltage capability and deposition resistance capability by adding a low melting metal (e.g., Te, etc.) to an electrode material having a MoCr fine dispersion texture.

However, in the sintering step of a MoCr fine dispersion electrode material containing a low melting metal added thereto, there was a risk that vacancies were generated in the electrode interior to result in lowering of packing percentage of the electrode material. Furthermore, there was a risk that dispersion occurred in packing percentage by the temperature distribution of the sintering furnace. If packing percentage of the electrode material lowers by the generation of vacancies in the electrode material, there is a risk that brazing material (e.g., Ag) is absorbed into vacancies of the electrode's inside in the brazing step to result in difficulty in brazing of the electrode material.

PRIOR ART PUBLICATIONS

Patent Publications

Patent Publication 1: JP Patent Application Publication 2002-180150.

Patent Publication 2: JP Patent Application Publication Heisei 4-334832.

Patent Publication 3: JP Patent Application Publication 2005-135778.

Non-Patent Publications

Non-patent Publication 1: Rieder, F u.a., "The Influence of Composition and Cr Particle Size of Cu/Cr Contacts on Chopping Current, Contact Resistance, and Breakdown Voltage in Vacuum Interrupters", IEEE Transactions on Components, Hybrids, and Manufacturing Technology, Vol. 12, 1989, 273-283.

SUMMARY OF THE INVENTION

It is an object of the present invention to provide a technology contributing to the improvement of packing percentage of an electrode material containing a low-melting metal and to the reduction of dispersion of packing percentage of the electrode material.

A method for manufacturing an electrode material of the present invention for achieving the above object comprises mixing a solid solution powder of Cr and a heat-resistant element, a Cu powder, and a low melting metal powder, the solid solution powder containing the Cr and the heat-resistant element in a ratio such that the Cr is greater than the heat-resistant element by weight, thereby obtaining a mixed powder; and sintering a compact prepared by pressing the mixed powder, at a temperature that is 1010° C. or higher and is lower than 1038° C.

Furthermore, according to a method for manufacturing an electrode material of the present invention for achieving the above object, in the method for manufacturing an electrode material, the solid solution powder is prepared by baking a mixed powder of a heat-resistant element powder and a Cr powder to obtain a sintered body and then pulverizing the sintered body, and the heat-resistant element powder has a median size of 10 μm or less.

Furthermore, according to a method for manufacturing an electrode material of the present invention for achieving the above object, in the method for manufacturing an electrode material, the solid solution powder is prepared by baking a mixed powder of a heat-resistant element powder and a Cr powder to obtain a sintered body and then pulverizing the sintered body, and the Cr powder has a median size that is greater than that of the heat-resistant element and is 80 μm or less.

Furthermore, according to a method for manufacturing an electrode material of the present invention for achieving the above object, in the method for manufacturing an electrode material, the Cu powder has a median size of 100 μm or less.

Furthermore, according to a method for manufacturing an electrode material of the present invention for achieving the above object, in the method for manufacturing an electrode material, the solid solution powder is classified to have a particle size of 200 μm or less, and then the classified solid solution powder is mixed with the Cu powder and the low melting metal powder.

Furthermore, an electrode material of the present invention for achieving the above object is an electrode material comprising 39.88 to 89.96 weight % of Cu, 4.99 to 47.98 weight % of Cr, 1.99 to 29.99 weight % of a heat-resistant element, and 0.05 to 0.30 weight % of a low meting metal, and the electrode material is prepared by mixing a solid solution powder of Cr and a heat-resistant element, a Cu powder, and a low melting metal powder, the solid solution powder containing the Cr and the heat-resistant element in a ratio such that the Cr is greater than the heat-resistant element by weight, thereby obtaining a mixed powder; and pressing the mixed powder, followed by sintering at a temperature that is 1010° C. or higher and is lower than 1038° C.

A vacuum interrupter of the present invention for achieving the above object is such that a movable electrode or a fixed electrode is equipped with the electrode material as an electrode contact.

MODE FOR IMPLEMENTING THE INVENTION

Figure 1:
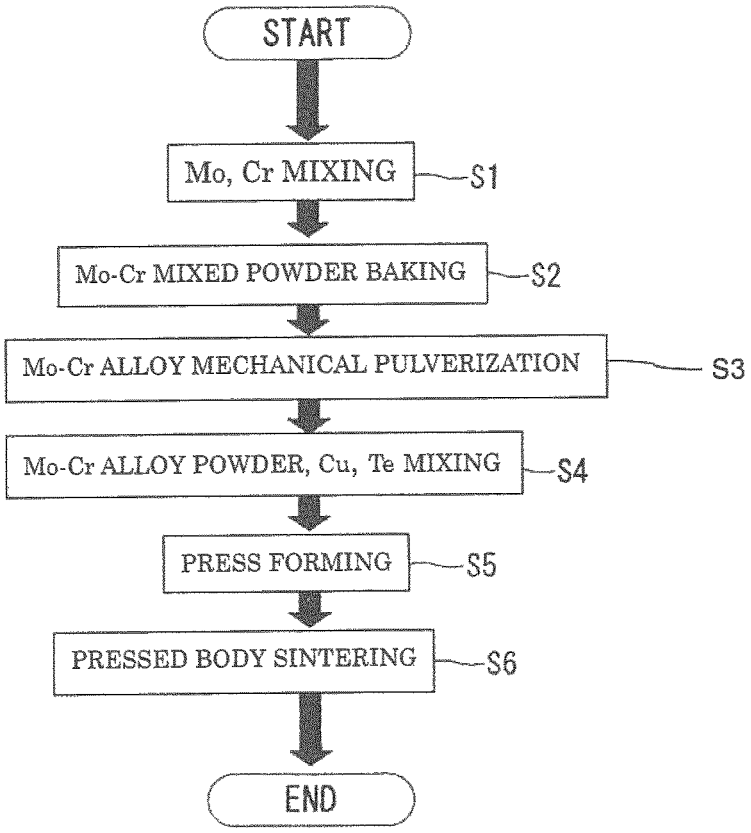
FIG. 1 is a flowchart of an electrode material manufacture method according to an embodiment of the present invention.

An electrode material manufacture method and an electrode material according to an embodiment of the present invention and a vacuum interrupter having an electrode material of the present invention are explained in detail with reference to the drawings. In the explanation of the embodiment, unless otherwise stated, the particle size (median size d50), the average particle size, etc. refer to values determined by a laser diffraction-type, particle size distribution measurement apparatus (a company CILAS; CILAS 1090L). Furthermore, in case that the upper limit (or lower limit) of the particle size of a powder is defined, it refers to a powder classified by a sieve having an opening of the upper limit value (or lower limit value) of the particle size.

Prior to the present invention, the inventors prepared an electrode material by a sintering method using a MoCr solid solution powder containing Mo and Cr in a ratio such that Cr is greater than Mo by weight, and a Cu powder (for example, Japanese Patent Application 2015-93765). This electrode material was an electrode material having a texture, in which MoCr alloy was finely dispersed in Cu base material, and having superior withstand voltage capability and deposition resistance capability as compared with conventional CuCr electrode materials. Furthermore, when a MoCr solid solution powder containing Mo and Cr in a ratio such that Cr was greater than Mo by weight was used, it resulted in an electrode material with a higher deposition resistance capability, as compared with the case of using a MoCr solid solution powder containing Mo and Cr in a ratio such that Cr was less than Mo by weight.

In order to downsize an operation mechanism for conducting opening and closing movements of the electrodes in a vacuum circuit breaker, it is desirable to further improve deposition resistance to reduce the peeling force when the electrode material has deposited. In order to do that, it is considered to add a low melting metal to the mixed powder of Cu powder and MoCr solid solution powder (e.g., Patent Publication 3). In the case of adding a low melting metal, however, packing percentage of the electrode material lowers. Therefore, there is a risk that brazing property between the electrode contact and the electrode rod becomes inferior.

Based on the above-mentioned situation, the inventors conducted an eager study and reached completion of the present invention. The present invention is an invention relating to a Cu—Cr-heat resistant element (Mo, W, V, etc.)-low melting metal (Te, Bi, etc.) electrode material, composition control technique. As compared with conventional electrode materials containing low melting metals, it improves packing percentage of the electrode material and suppresses dispersion of the packing percentage by limiting sintering temperature of the electrode material. The electrode material of the present invention is an electrode material that is superior in withstand voltage capability and deposition resistance capability and is small in packing percentage dispersion. Therefore, according to the electrode material of the present invention, yield of vacuum interrupters improves, and it becomes possible to downsize vacuum interrupters.

As the heat-resistant element, an element selected from elements, such as molybdenum (Mo), tungsten (W), tantalum (Ta), niobium (Nb), vanadium (V), zirconium (Zr), beryllium (Be), hafnium (Hf), iridium (Ir), platinum (Pt), titanium (Ti), silicon (Si), rhodium (Rf) and ruthenium (Ru), can be used singly or in combination. In particular, it is preferable to use Mo, W, Ta, Nb, V or Zr, which is remarkable in the effect of making the Cr particles fine. In the case of using the heat-resistant element as powder, the median size d50 of the heat-resistant element powder is adjusted, for example, to 10 μm or less. With this, it is possible to make Cr-containing particles (containing a solid solution of the heat-resistant element and Cr) fine and uniformly disperse them in the electrode material. By containing 1.99-29.99 weight %, more preferably 1.99-10.00 weight %, of the heat-resistant element relative to the electrode material, it is possible to improve withstand voltage capability and current breaking capability of the electrode material without lowering mechanical strength and workability.

As the low melting metal, an element selected from elements such as tellurium (Te), bismuth (Bi), selenium (Se) and antimony (Sb) can be used singly or in combination. If the low melting metal is contained by 0.05-0.30 weight % relative to the electrode material, it is possible to improve the electrode material in deposition resistance. In the case of using the low melting metal as a powder, the particle size of the low melting metal is not particularly limited. For example, there is used a low melting metal powder having a median size d50 of 48 μm.

By containing 4.99-47.98 weight %, more preferably 4.99-15.99 weight %, of chromium (Cr) relative to the electrode material, it is possible to improve withstand voltage capability and current breaking capability of the electrode material without lowering mechanical strength and workability. In the case of using Cr powder, the median size d50 of Cr powder is not particularly limited as long as it is greater than the median size of the heat-resistant element powder. For example, a Cr powder having a median size of 80 μm or less is used.

By containing 39.88-89.96 weight %, more preferably 79.76-89.96 weight %, of copper (Cu) relative to the electrode material, it is possible to reduce contact resistance of the electrode material without lowering withstand voltage capability and current breaking capability. By adjusting median size d50 of Cu powder, for example, to 100 μm or less, it is possible to uniformly mix a solid solution powder of the heat-resistant element and Cr with Cu powder. In the electrode material to be manufactured by the sintering method, it is possible to freely set the Cu weight ratio by adjusting the amount of Cu powder to be mixed with a solid solution powder of the heat-resistant element and Cr. Therefore, the total of the heat-resistant element, Cr and Cu to be added to the electrode material never exceeds 100 weight %.

The electrode material manufacture method according to the embodiment of the present invention is explained in detail with reference to flow of FIG. 1. The explanation of the embodiment is conducted by showing Mo as an example of the heat-resistant element and Te as an example of the low melting metal, but it is similar in the case of using other heat-resistant elements and low melting metal powders, too.

In the Mo—Cr mixing step S1, the heat-resistant element powder (e.g., Mo powder) is mixed with Cr powder. The Mo powder and the Cr powder are mixed together such that the weight of the Cr powder becomes greater than the weight of the Mo powder. The Mo powder and the Cr powder are mixed together, for example, in a range that Mo/Cr=1/4 to 1/1 (Mo:Cr=1:1 is not included) by weight.

In the baking step S2, a mixed powder of Mo powder and Cr powder is baked. In the baking step S2, for example, a compact of the mixed powder is retained in a vacuum atmosphere at a temperature of 900-1200° C. for 1 to 10 hours to obtain MoCr sintered body. In case that the weight of the Cr powder is greater than that of the Mo powder in the mixed powder, there remains Cr that does not form a solid solution with Mo after the baking. Therefore, there is obtained a porous body (MoCr sintered body) containing a MoCr alloy resulting from solid phase diffusion of Cr into Mo and the remaining Cr particles.

In the pulverization and classification step S3, the MoCr sintered body obtained by the sintering step S2 is pulverized by a ball mill, etc. MoCr powder to be obtained by pulverizing the MoCr sintered body is classified by a sieve having, for example, an opening of 200 μm, more preferably an opening of 90 μm, to remove particles having large particle sizes. The pulverization in the pulverization and classification step S3 is conducted, for example, for two hours per 1 kg of the MoCr sintered body. The average particle size of the MoCr powder after the pulverization becomes different, depending on the mixing ratio of Mo powder and Cr powder.

In the Cu mixing step S4, MoCr powder obtained by the pulverization and classification step S3 is mixed with a low melting metal powder (for example, Te powder) and Cu powder.

In the press forming step S5, forming of a mixed powder obtained by the Cu mixing step S4 is conducted. If a compact is manufactured by a press molding, it is not necessary to conduct machining on the compact after the sintering. Therefore, it can directly be used as an electrode (electrode contact material).

In the primary sintering step S6, a compact obtained by the press forming step S5 is sintered to manufacture an electrode material. In the primary sintering step S6, sintering of the compact is conducted, for example, in a non-oxidizing atmosphere (hydrogen atmosphere, vacuum atmosphere, etc.) at a temperature that is 1010° C. or higher and is lower than 1038° C., more preferably at a temperature that is 1010° C. or higher and is 1030° C. or lower. Sintering time of the primary sintering step S6 is suitably set in accordance with the sintering temperature. For example, the sintering time is set at two hours or longer.

Figure 2:
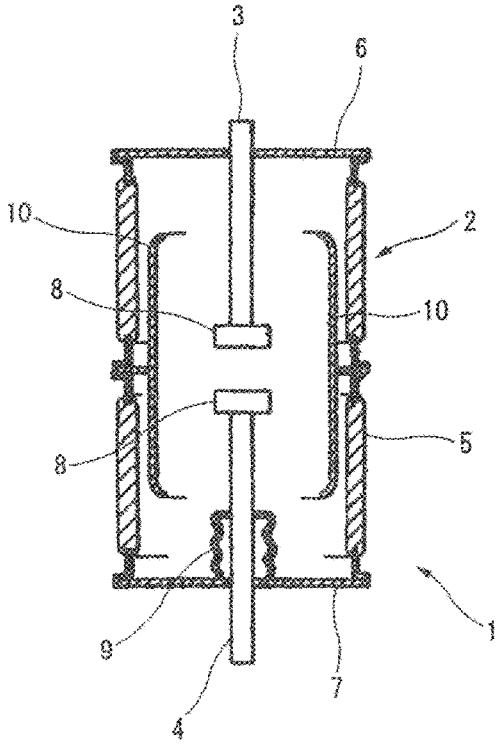
FIG. 2 is a schematic sectional view showing a vacuum interrupter having the electrode material according to the embodiment of the present invention.

By using the electrode material according to the embodiment of the present invention, it is possible to construct a vacuum interrupter. As shown in FIG. 2, a vacuum interrupter 1 having the electrode material according to the embodiment of the present invention has a vacuum container 2, a fixed electrode 3, a movable electrode 4, and a main shield 10.

The vacuum container 2 is formed by sealing both opening end portions of an insulating sleeve 5 with a fixed-side end plate 6 and a movable-side end plate 7, respectively.

The fixed electrode 3 is fixed in a condition that it passes through the fixed-side end plate 6. One end of the fixed-side electrode 3 is fixed to be opposed to one end of the movable electrode 4 in the vacuum container 2. An end portion of the fixed electrode 3, which is opposed to the movable electrode, is formed with an electrode contact material 8, which is the electrode material according to the embodiment of the present invention. Electrode contact material 8 is joined to an end portion of the fixed electrode 3 by a brazing material (e.g., Ag—Cu based brazing material).

The movable electrode 4 is provided at the movable-side end plate 7. The movable electrode 4 is provided to be coaxial with the fixed electrode 3. The movable electrode 4 is moved in an axial direction by an opening/closing means not shown in the drawings, thereby conducting an opening or closing between the fixed electrode 3 and the movable electrode 4. An end portion of the movable electrode 4, which is opposed to the fixed electrode 3, is formed with an electrode contact material 8. The electrode contact material 8 is joined to an end portion of the movable electrode 4 by brazing material. Bellows 9 are provided between the movable electrode 4 and the movable-side end plate 7. Therefore, while vacuum of the inside of the vacuum container 2 is maintained, the movable electrode 4 is moved in a vertical direction to conduct an opening/closing between the fixed electrode 3 and the movable electrode 4.

The main shield 10 is provided to cover a contact portion between the electrode contact material 8 of the fixed electrode 3 and the electrode contact material 8 of the movable electrode 4, thereby protecting the insulating sleeve 5 from an are that occurs between the fixed electrode 3 and the movable electrode 4.

COMPARATIVE EXAMPLE 1

An electrode material according to Comparative Example 1 was manufactured in accordance with the flow shown in FIG. 1. The electrode material of Comparative Example 1 was an electrode material prepared by sintering a compact at 1058° C. for two hours in the primary sintering step S6. As the raw materials of the electrode material of Comparative Example 1, Mo powder having a median size of 10 μm or less, Te powder having a median size of 48 μm, termite Cr powder having a median size of 80 μm or less and Cu powder having a median size of 100 μm or less were used. The electrode materials according to Examples 1 to 3 and Comparative Examples 2 to 4 were also manufactured by using the same raw materials.

Firstly, Mo powder and Cr powder were mixed together in a weight ratio of Mo:Cr=1:4, and it was sufficiently mixed by using a V-type mixer until becoming homogeneous.

After mixing, this mixed powder of Mo powder and Cr powder was transferred into an alumina container and subjected to a heat treatment in a vacuum furnace (non-oxidizing atmosphere) at 1150° C. for six hours. A porous body as the obtained reaction product was pulverized and then classified by a sieve having an opening of 90 μm, thereby obtaining a MoCr powder under 90 μm.

Next, Te powder, Cu powder and the classified MoCr powder were mixed together in a weight ratio of Cu:MoCr=4:1 and a weight ratio of CuCrMo:Te=100:0.1, followed by a sufficient mixing using a V-type mixer until becoming homogeneous. This mixed powder was formed by a press mold forming into a compact. The compact was subjected to the primary sintering in a non-oxidizing atmosphere at 1058° C. for two hours to obtain an electrode material. By the same method, three of the electrode material of Comparative Example 1 were prepared (the number of samples N=3).

TABLE 1

| Classification | Sintering temp. ° C. | Packing percentage average (%) | Standard deviation of packing percentage σ | Brazing property |
|---|---|---|---|---|
| Com. Ex. 1 | 1058 | 84% | 5.7 | X |
| Com. Ex. 2 | 1045 | 86% | 4.7 | X |
| Com. Ex. 3 | 1038 | 89% | 2.4 | X |
| Example 1 | 1030 | 91% | 0.4 | ○ |
| Example 2 | 1020 | 90% | 0.5 | ○ |
| Example 3 | 1010 | 90% | 0.4 | ○ |
| Com. Ex. 4 | 990 | 88% | 0.5 | X |

Figure 3:
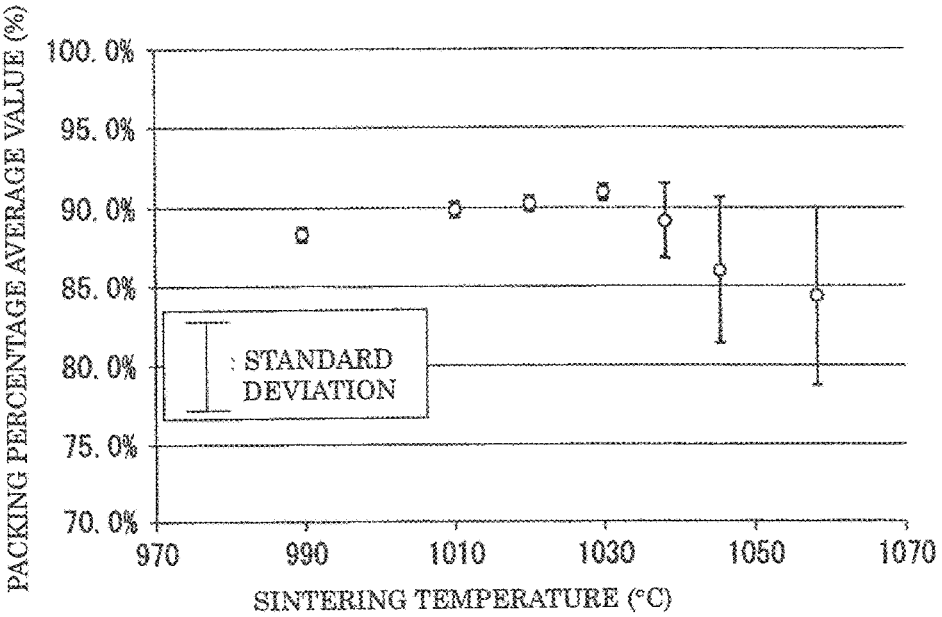
FIG. 3 is a characteristic graph showing a relationship between the sintering temperature and the packing percentage.

Table 1 shows characteristics of the electrode material of Comparative Example 1. Furthermore, FIG. 3 shows a graph prepared by plotting packing percentage of the electrode material relative to the sintering temperature. Density of the sintered body was actually measured, and packing percentage was calculated from (measured density/theoretical density)×100(%). Furthermore, brazing property was evaluated in terms of two points by conducting a brazing with Ag—Cu based brazing material between the electrode material and a lead to see if fillet is formed or not, and by hitting the brazed electrode material with a hammer to see if the electrode material comes off the lead or not. That is, a good brazing with the formation of fillet is conducted if a brazing material (Ag) is brazed in a manner that the brazing material is not absorbed by a large amount into the electrode material at the brazing.

The average value (N=3) of packing percentage of the electrode material of Comparative Example 1 was 84%. Furthermore, standard deviation a of packing percentage was 5.7. As a result of checking brazing property of the electrode material of Comparative Example 1, brazing was not made. That is, fillet was not formed when conducting the brazing, and the electrode material came off the lead by hitting with a hammer (Comparative Examples 2 to 4 were also similar).

Figure 4:
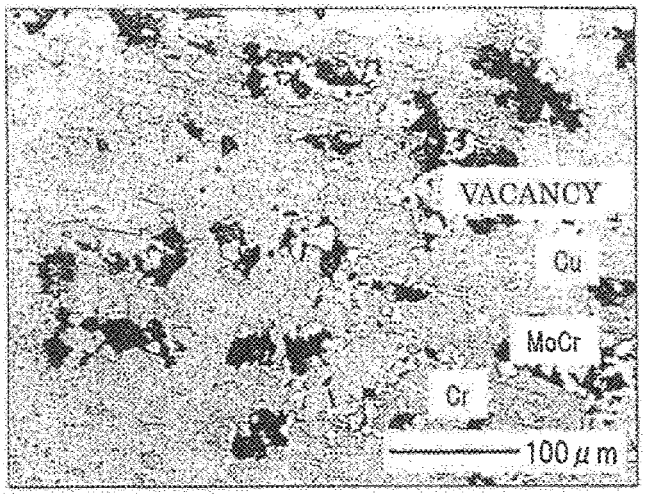
FIG. 4 is a sectional microphotograph of the electrode material according to Comparative Example 1.

FIG. 4 shows a sectional microphotograph of the electrode material of Comparative Example 1. As shown in FIG. 4, many vacancies were formed in an electrode texture of the electrode material of Comparative Example 1. In this way, many vacancies in the electrode texture lowers packing percentage of the electrode material. Furthermore, it results in Ag as a component of the brazing material being absorbed into the inside of the electrode. This is considered to lower brazing property of the electrode material.

COMPARATIVE EXAMPLE 2

The electrode material of Comparative Example 2 is an electrode material prepared by the same method as that of Comparative Example 1, except that the sintering temperature in the primary sintering step S6 was different.

The electrode material of Comparative Example 2 was prepared in accordance with the flow shown in FIG. 1 (the number of samples N=3). In the primary sintering step S6, the compact was sintered at 1045° C. for two hours.

As shown in Table 1 and FIG. 3, the average value (N=3) of packing percentage of the electrode material of Comparative Example 2 was 86%. Furthermore, standard deviation a of packing percentage was 4.7. As a result of checking brazing property of the electrode material of Comparative Example 2, brazing was not made.

COMPARATIVE EXAMPLE 3

The electrode material of Comparative Example 3 is an electrode material prepared by the same method as that of Comparative Example 1, except that the sintering temperature in the primary sintering step S6 was different.

The electrode material of Comparative Example 3 was prepared in accordance with the flow shown in FIG. 1 (the number of samples N=3). In the primary sintering step S6, the compact was sintered at 1038° C. for two hours.

As shown in Table 1 and FIG. 3, the average value (N=3) of packing percentage of the electrode material of Comparative Example 3 was 89%. Furthermore, standard deviation a of packing percentage was 2.4. As a result of checking brazing property of the electrode material of Comparative Example 3, brazing was not made.

EXAMPLE 1

The electrode material of Example 1 is an electrode material prepared by the same method as that of Comparative Example 1, except that the sintering temperature in the primary sintering step S6 was different.

The electrode material of Example 1 was prepared in accordance with the flow shown in FIG. 1 (the number of samples N=3). In the primary sintering step S6, the compact was sintered at 1030° C. for two hours.

As shown in Table 1 and FIG. 3, the average value (N=3) of packing percentage of the electrode material of Example 1 was 91%. Furthermore, standard deviation a of packing percentage was 0.4. As a result of checking brazing property of the electrode material of Example 1, brazing property was good. That is, when conducting brazing, fillet was formed, and the electrode material did not come off the lead even when the electrode material was hit with a hammer (Examples 2 and 3 were also similar).

Figure 5:
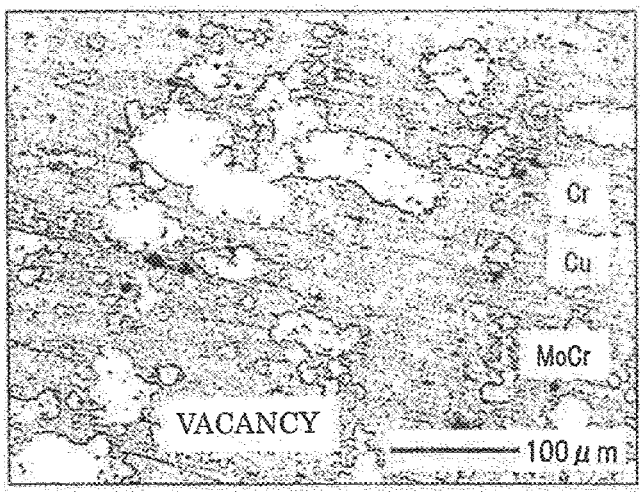
FIG. 5 is a sectional microphotograph of the electrode material according to Example 1.

FIG. 5 shows a sectional microphotograph of the electrode material according to Example 1. It is understood that the occurrence of vacancies in the electrode material texture is suppressed in the electrode material of Example 1, as compared with the electrode material of Comparative Example 1.

EXAMPLE 2

The electrode material of Example 2 is an electrode material prepared by the same method as that of Comparative Example 1, except that the sintering temperature in the primary sintering step S6 was different.

The electrode material of Example 2 was prepared in accordance with the flow shown in FIG. 1 (the number of samples N=3). In the primary sintering step S6, the compact was sintered at 1020° C. for two hours.

As shown in Table 1 and FIG. 3, the average value (N=3) of packing percentage of the electrode material of Example 2 was 90%. Furthermore, standard deviation a of packing percentage was 0.5. As a result of checking brazing property of the electrode material of Example 2, brazing property was good.

EXAMPLE 3

The electrode material of Example 3 is an electrode material prepared by the same method as that of Comparative Example 1, except that the sintering temperature in the primary sintering step S6 was different.

The electrode material of Example 3 was prepared in accordance with the flow shown in FIG. 1 (the number of samples N=3). In the primary sintering step S6, the compact was sintered at 1010° C. for two hours.

As shown in Table 1 and FIG. 3, the average value (N=3) of packing percentage of the electrode material of Example 3 was 90%. Furthermore, standard deviation a of packing percentage was 0.4. As a result of checking brazing property of the electrode material of Example 3, brazing property was good.

COMPARATIVE EXAMPLE 4

The electrode material of Comparative Example 4 is an electrode material prepared by the same method as that of Comparative Example 1, except that the sintering temperature in the primary sintering step S6 was different.

The electrode material of Comparative Example 4 was prepared in accordance with the flow shown in FIG. 1 (the number of samples N=3). In the primary sintering step S6, the compact was sintered at 990° C. for two hours.

As shown in Table 1 and FIG. 3, the average value (N=3) of packing percentage of the electrode material of Comparative Example 4 was 88%. Furthermore, standard deviation a of packing percentage was 0.5.

In the electrode material of Comparative Example 4, the sintering temperature is lower than 1000° C. It is considered that, under such low sintering temperature, a dispersion reaction of Cr and Mo at the sintering is suppressed, thereby not allowing sintering of the electrode material itself to progress, although standard deviation of packing percentage is small. As a result, the average value of packing percentage becomes lower as compared with the electrode material of Example 1. This makes brazing difficult.

According to the above-mentioned electrode material manufacture method pertaining to the embodiment of the present invention, it is possible to improve packing percentage of the electrode material by limiting the sintering temperature of the primary sintering step to a temperature that is 1010° C. or higher and is lower than 1038° C.

That is, it is possible to suppress a dispersion reaction of Cr and Mo at the sintering by setting the sintering temperature at lower than 1038° C. By suppressing the dispersion reaction at the sintering in this way, vacancies to be formed in the electrode material decrease. With this, it is possible to make the electrode material have a packing percentage of 90% or greater and thereby to manufacture an electrode material superior in brazing property.

By suppression of the dispersion reaction at the sintering, it is possible to greatly decrease dispersion (standard deviation) of packing percentage caused by the temperature distribution in the furnace. This makes it possible to obtain an electrode material having a stable brazing capability. It is considered that dispersion of packing percentage of the electrode material is generated due to the temperature distribution of the sintering furnace (±15° C., for example, in a vacuum furnace used in Examples). By limiting the sintering temperature range, however, it is possible to make the electrode material have a packing percentage dispersion (standard deviation) of 1% or lower. By making standard deviation of packing percentage small, it becomes possible to improve yield in mass-production.

That is, according to the electrode material manufacture method related to the embodiment of the present invention, it is possible to manufacture an electrode material that is high in packing percentage and small in packing percentage dispersion. Since this electrode material has a superior withstand voltage capability by having a MoCr fine dispersion texture and a deposition resistance capability higher than that of the current Cu—Cr electrodes, it becomes possible to manufacture a small-sized vacuum interrupter. That is, withstand voltage capability of the electrode contact of a vacuum interrupter is improved by mounting the electrode material of the present invention on at least one of the fixed electrode and the movable electrode, for example, of a vacuum interrupter (VI). As withstand voltage capability of the electrode contact is improved, it is possible to shorten the gap between the movable side electrode and the fixed side electrode at the opening/closing time as compared with conventional vacuum interrupters and to shorten the gap between the electrode and the insulating sleeve, too. Therefore, it becomes possible to make structure of the vacuum interrupter small. Furthermore, as deposition resistance capability of the electrode material is improved, it is possible to make small an operation mechanism for conducting an opening/closing movement of the vacuum interrupter, thereby contributing to making the vacuum circuit breaker have a small size.

It is considered that there are at least the following two factors to generate vacancies in Cu—Cr-heat resistant element-low melting metal based electrode materials. The first factor is that the remaining Cr and Mo react by a solid phase dispersion at sintering the electrodes to generate vacancies. Since the solid phase dispersion tends to occur at a higher sintering temperature, the dispersion is considered to progress at a higher sintering temperature. Furthermore, the second factor is that the addition of a low melting metal makes the low melting metal penetrate into grain boundaries of Cu/Cr or Cu/Mo at the sintering to interfere with the sintering and have a tendency to generate vacancies at the grain boundaries. For example, Te has a low melting temperature of 445° C. and is melted at the sintering of the electrode material. Therefore, vacancies tend to occur. That is, when a low melting metal is added, in the first place sintering does not progress smoothly, and vacancies tend to occur at the grain boundaries. Therefore, in an electrode material containing a low melting metal, the occurrence of vacancies in the electrode material is considered to become significant not only by the first factor, but also by the second factor. Thus, like the electrode material manufacture method and the electrode material according to the embodiment of the present invention, it is possible to implement sintering with a high packing percentage, while suppressing Mo—Cr dispersion and volatilization of the low melting metal, by limiting the sintering temperature to a temperature that is 1010° C. or higher and is lower than 1038° C.

In the electrode material manufacture method of the present invention, the dispersion reaction of Cr and Mo (i.e., a heat-resistant element) at the primary sintering is suppressed, thereby decreasing vacancies and improving packing percentage. Therefore, it is considered that the advantageous effects of the present invention cannot be obtained in the case of using a perfect solid solution powder in which Mo is perfectly dissolved in Cr. However, in a solid solution between Mo powder and Cr powder, which are mixed together in a ratio such that Cr is greater than Mo by weight, it is not easy to make a perfect solid solution of Mo. Therefore, in the case of forming a MoCr solid solution by mixing Mo powder and Cr powder in a ratio such that Cr is greater than Mo by weight, the obtained MoCr solid solution powder is considered not be a perfect solid solution of Mo and Cr (other heat-resistant elements are also similar). For example, a perfect solid solution of Mo was not formed under the treatment condition of the baking step S2 of the electrode material of Example 1. Furthermore, in the case of increasing the proportion of Cr, a sintering reaction among Cr tends to occur at the preliminary sintering. Therefore, the formation of a perfect solid solution of Mo is considered to be difficult.

As above, the explanation of the embodiments was conducted by showing preferable modes of the present invention, but the electrode material manufacture method and the electrode material of the present invention are not limited to the embodiments. It is possible to suitably change the design in a range of not impairing characteristics of the invention, and the embodiment with the changed design also belongs to the technical scope of the present invention.

For example, the MoCr solid solution powder is not limited to one manufactured by a preliminary sintering of Mo powder and Cr powder and then pulverization and classification, but it is possible to use a MoCr solid solution powder containing Mo and Cr in a ratio such that Cr is greater than Mo by weight. Furthermore, it is possible to manufacture an electrode material superior in withstand voltage capability by using, for example, a powder of 80 μm or less at 50% by cumulation for the MoCr solid solution powder.

The invention claimed is:

1. A method for manufacturing an electrode material, comprising:

mixing a solid solution powder of Cr and a heat-resistant element, a Cu powder, and a low melting metal powder, the solid solution powder containing the Cr and the heat-resistant element in a ratio such that the Cr is greater than the heat-resistant element by weight, thereby obtaining a mixed powder; and sintering a compact prepared by pressing the mixed powder, at a temperature that is 1010° C. or higher and is lower than 1038° C., wherein the heat-resistant element is Mo, and the low melting metal powder is a Te powder.

2. The method for manufacturing an electrode material as claimed in claim 1, wherein the solid solution powder is prepared by baking a mixed powder of a Mo powder and a Cr powder to obtain a sintered body and then pulverizing the sintered body, and wherein the Mo powder has a median size of 10 μm or less.

3. The method for manufacturing an electrode material as claimed in claim 1, wherein the solid solution powder is prepared by baking a mixed powder of a Mo powder and a Cr powder to obtain a sintered body and then pulverizing the sintered body, and wherein the Cr powder has a median size that is greater than that of the Mo powder and is 80 μm or less.

4. The method for manufacturing an electrode material as claimed in claim 1, wherein the Cu powder has a median size of 100 μm or less.

5. The method for manufacturing an electrode material as claimed in claim 1, wherein the solid solution powder is classified to have a particle size of 200 μm or less and then the classified solid solution powder is mixed with the Cu powder and the Te powder.

6. The method for manufacturing an electrode material as claimed in claim 1, wherein the Mo is in an amount of 1.99-29.99 weight % relative to the electrode material.

7. The method for manufacturing an electrode material as claimed in claim 1, wherein the Te is in an amount of 0.05-0.30 weight % relative to the electrode material.

8. The method for manufacturing an electrode material as claimed in claim 1, wherein the Cr is in an amount of 4.99-47.98 weight % relative to the electrode material.

9. The method for manufacturing an electrode material as claimed in claim 1, wherein the Cu powder is in an amount of 39.88-89.96 weight % relative to the electrode material.

10. The method for manufacturing an electrode material as claimed in claim 1, wherein the solid solution powder is prepared by baking a mixed powder of a Mo powder and a Cr powder to obtain a sintered body and then pulverizing the sintered body.

* * * * *